US010010198B2

(12) United States Patent
Dubois et al.

(10) Patent No.: US 10,010,198 B2
(45) Date of Patent: Jul. 3, 2018

(54) SLEEPING BAG WITH BLANKET

(71) Applicant: Exxel Outdoors, LLC, Boulder, CO (US)

(72) Inventors: Joe Dubois, Lafayette, CO (US); Andrew Day, Lafayette, CO (US); Scott Neilson, Erie, CO (US); Jesse Anderson, Lafayette, CO (US); Chris Grill, Broomfield, CO (US)

(73) Assignee: Exxel Outdoors, LLC, Boulder, CO (US)

( * ) Notice: Subject to any disclaimer, the term of this patent is extended or adjusted under 35 U.S.C. 154(b) by 41 days.

(21) Appl. No.: 15/216,295

(22) Filed: Jul. 21, 2016

(65) Prior Publication Data

US 2017/0020311 A1 Jan. 26, 2017

Related U.S. Application Data

(60) Provisional application No. 62/194,930, filed on Jul. 21, 2015.

(51) Int. Cl.
*A47G 9/08* (2006.01)
*A47G 9/02* (2006.01)

(52) U.S. Cl.
CPC ..... *A47G 9/086* (2013.01); *A47G 9/0223* (2013.01)

(58) Field of Classification Search
CPC ..... A47G 9/08
USPC ..... 5/413 R, 413 AM
See application file for complete search history.

(56) References Cited

U.S. PATENT DOCUMENTS

| | | | |
|---|---|---|---|
| 35,922 | A | 7/1862 | Chapelle |
| 327,255 | A | 9/1885 | Haaf |
| 366,858 | A | 7/1887 | Mefferd |
| 510,239 | A | 12/1893 | Carr |
| 541,995 | A | 7/1895 | Denton |
| 559,641 | A | 5/1896 | Walsh |
| 560,961 | A | 5/1896 | Zimmerman |
| 569,521 | A | 10/1896 | Scatchard |
| 578,358 | A | 3/1897 | Phelps |
| 598,995 | A | 2/1898 | Jacob |
| 608,351 | A | 8/1898 | Terramorse |
| 611,829 | A | 10/1898 | Brown |
| 613,545 | A | 11/1898 | Winters |
| 615,642 | A | 12/1898 | Stebbins |
| 622,812 | A | 4/1899 | Lapierre |
| 831,733 | A | 9/1906 | Moore |
| 867,464 | A | 10/1907 | Abbott |
| 872,122 | A | 11/1907 | Guild |
| 872,404 | A | 12/1907 | Burch |
| 874,551 | A | 12/1907 | Wallis |
| 887,029 | A | 5/1908 | Burch |
| 896,689 | A | 8/1908 | Canfield |

(Continued)

*Primary Examiner* — Fredrick C Conley
(74) *Attorney, Agent, or Firm* — Stintson Leonard Street LLP

(57) ABSTRACT

A sleeping bag has an elongate shell defining a longitudinal centerline and an inner volume sized and shaped to receive a user therein, the shell having a head portion, a foot portion, a middle portion extending longitudinally between the head and foot portions, an overlying portion adapted to overlie the user during use, and an underlying portion adapted to underlie the user during use. A blanket is coupled to the shell and configured to selectively move between a closed position within the inner volume and an open position beyond the shell.

20 Claims, 11 Drawing Sheets

(56) References Cited

U.S. PATENT DOCUMENTS 902,133 A 10/1908 Burch
917,403 A 4/1909 Benger
921,751 A 5/1909 Strawn
928,391 A 7/1909 Lukenbill
929,357 A 7/1909 Whitney
965,921 A 8/1910 Mercey
976,866 A 11/1910 Gordon
983,223 A 1/1911 Fitch
1,039,509 A 9/1912 Gail
1,048,806 A 12/1912 Burch
1,054,818 A 3/1913 Bergan
1,064,630 A 6/1913 Fiala
1,071,764 A 9/1913 Lowrimore
1,079,798 A 11/1913 Painter
1,091,402 A 3/1914 Stout
1,102,200 A 6/1914 Miller
1,102,408 A 7/1914 Huebner et al.
1,116,074 A 11/1914 Jones
1,158,356 A 12/1914 Wilson
1,130,116 A 3/1915 Stevenson
1,159,788 A 11/1915 Newbell
1,195,394 A 12/1915 Panet
1,167,058 A 1/1916 Finberg
1,204,416 A 11/1916 Doser
1,238,340 A 8/1917 Robeson
1,241,699 A 10/1917 Barnes
1,247,882 A 11/1917 Row
1,277,781 A 12/1917 Trammell
1,253,039 A 1/1918 Hunt
1,254,124 A 1/1918 Converse
1,260,845 A 3/1918 Winder
1,263,825 A 4/1918 Waugh
1,264,971 A 5/1918 Pickles
1,265,539 A 5/1918 Slater
1,267,551 A 5/1918 Jacobs
1,281,692 A 10/1918 Stonebridge
1,281,693 A 10/1918 Stonebridge
1,284,046 A 11/1918 Blocksom
1,315,294 A 9/1919 Fink et al.
2,008,919 A 7/1935 Milkes
2,374,299 A 4/1945 O'Hara
2,376,617 A 5/1945 O'Reilley
2,378,434 A 6/1945 Bestor
2,379,416 A 7/1945 Clark
2,399,782 A 5/1946 Asher
2,401,230 A 5/1946 Colley
2,431,603 A 11/1947 Zito
2,449,758 A 9/1948 Clementine
2,478,765 A 8/1949 Kim
2,491,394 A 12/1949 Rose
2,497,167 A 2/1950 Guyol
2,504,761 A 4/1950 Turco
2,524,429 A 10/1950 Devin
2,535,936 A 12/1950 Langley
2,537,537 A 1/1951 Briit
2,538,420 A 1/1951 Junghans
2,555,051 A 5/1951 Miller
2,572,490 A 10/1951 Kaplan
2,579,948 A 12/1951 Miller
2,581,357 A 1/1952 Burstein
2,588,536 A 3/1952 Kaplan
2,594,438 A 4/1952 Howe
2,620,493 A 12/1952 Brelsford
2,625,695 A 1/1953 Nicholson
2,637,048 A 5/1953 Peters et al.
2,644,948 A 7/1953 Addis
2,656,844 A 10/1953 Kreuzer
2,675,552 A 4/1954 Lillian
2,702,385 A 2/1955 Goldberg
2,707,988 A 5/1955 Shaub et al.
2,711,546 A 6/1955 Licht
2,720,654 A 10/1955 Stephenson
2,730,721 A 1/1956 Veen
2,757,390 A 8/1956 Albert
2,803,824 A 8/1957 Parish
2,830,305 A 4/1958 Freepons
2,888,009 A 5/1959 Taynor
2,907,056 A 10/1959 Julius
2,918,683 A 12/1959 Julius
2,931,043 A 4/1960 Martin
2,950,221 A 8/1960 Jackson et al.
2,971,205 A 2/1961 Shultz
2,972,757 A 2/1961 Gaynor
3,003,164 A 10/1961 Calvelage
3,034,132 A 5/1962 Bernard et al.
3,042,939 A 7/1962 Schoellkopf et al.
3,045,261 A 7/1962 Hocherman
3,083,378 A 4/1963 Pursell
3,175,231 A 3/1965 Magarop et al.
3,178,734 A 4/1965 Alexander
3,228,034 A 1/1966 Grove
3,284,818 A 11/1966 Lutz
3,334,363 A 8/1967 Lutz
3,341,869 A 9/1967 Whitman
3,380,087 A 4/1968 Petty et al.
3,381,306 A 5/1968 Innes
3,412,410 A 11/1968 Denfeld
3,443,066 A 5/1969 Weibel
3,460,170 A 8/1969 Ozier
3,477,552 A 11/1969 Goldman
3,483,575 A 12/1969 McCarthy
3,510,889 A 5/1970 Peterson
3,523,302 A 8/1970 Rabedeaux
3,541,620 A 11/1970 Chapuis
3,564,629 A 2/1971 Rogius
3,584,323 A * 6/1971 Worley ..... A47G 9/086
2/69.5
3,633,227 A 1/1972 Tegeler
3,639,931 A 2/1972 McGuire
3,673,036 A 6/1972 Lipe
3,695,507 A 10/1972 Sams
3,708,810 A 1/1973 Merikallio
3,750,202 A 8/1973 Merikallio
3,774,249 A 11/1973 Ybarra et al.
3,787,906 A 1/1974 Hunt
3,831,206 A 8/1974 Geary
3,837,019 A 9/1974 Hoff
3,839,756 A 10/1974 Hibbert et al.
3,842,454 A 10/1974 Young
3,857,125 A 12/1974 Hunt
3,860,980 A 1/1975 Ebert
3,877,092 A 4/1975 Gaiser
3,878,574 A 4/1975 Erickson
3,924,273 A 12/1975 Donovan
3,959,834 A 6/1976 Hunt
3,964,113 A 6/1976 Dean
3,965,505 A 6/1976 Thorowgood
3,979,784 A 9/1976 Boothe
3,988,791 A 11/1976 Simon
4,012,800 A 3/1977 Mitchell et al.
4,033,001 A 7/1977 Kern
4,035,855 A 7/1977 Kim
4,040,371 A 8/1977 Cooper et al.
4,079,472 A 3/1978 Maguire
4,087,874 A 5/1978 Callaway et al.
4,090,269 A 5/1978 Hunt
4,091,482 A 5/1978 Malcolm
4,103,377 A 8/1978 Mayer et al.
4,125,903 A 11/1978 Farrell
4,125,909 A 11/1978 Jacobson
4,128,908 A 12/1978 Kerbs
4,147,829 A 4/1979 Holland
4,158,892 A 6/1979 Gonzales
4,169,428 A 10/1979 Waugh
4,183,111 A 1/1980 Zahavkochav
4,197,601 A 4/1980 Maguire
4,206,512 A 6/1980 Osborne
D256,202 S 8/1980 Schmickel
4,236,263 A 12/1980 Allee
4,238,871 A 12/1980 Cannon
D259,531 S 6/1981 Prouty
4,277,859 A 7/1981 Seaman
4,292,700 A 10/1981 Markel
4,316,287 A 2/1982 Rule

(56) References Cited

U.S. PATENT DOCUMENTS 4,330,889 A 5/1982 Driscoll
4,339,835 A 7/1982 Jaffe et al.
4,354,281 A 10/1982 Satoh
D269,658 S 7/1983 Bor
D271,071 S 10/1983 Koether
4,413,368 A 11/1983 Schuetze
4,458,372 A 7/1984 Mills
4,471,518 A 9/1984 Gold
4,484,362 A 11/1984 Asher
4,487,451 A 12/1984 Fiorini
4,501,362 A 2/1985 Duncan
4,507,805 A 4/1985 Calutoiu
4,513,461 A 4/1985 Tardivel
4,547,906 A 10/1985 Nishida et al.
4,574,397 A 3/1986 Dennard
4,575,876 A 3/1986 Weaver
4,575,884 A 3/1986 Jamerson et al.
4,579,753 A 4/1986 Gjendemsjo
4,587,682 A 5/1986 Schultz
4,590,632 A 5/1986 Meyer
4,590,633 A 5/1986 Pickens
4,597,121 A 7/1986 Bouma
4,601,076 A 7/1986 Knobeloch
4,605,029 A 8/1986 Russell
4,674,130 A 6/1987 Coudron
4,680,821 A 7/1987 Maguire
4,688,282 A 8/1987 Jeffries
4,698,862 A 10/1987 Mairs
4,719,935 A 1/1988 Gustafson
4,739,529 A 4/1988 Mills
4,757,832 A 7/1988 Russell
4,774,734 A 10/1988 Mills
4,787,105 A 11/1988 Phillips et al.
4,790,040 A 12/1988 Grillot et al.
4,840,841 A 6/1989 Madsen
4,841,587 A 6/1989 Carter et al.
4,856,131 A 8/1989 Mills
4,862,533 A 9/1989 Adams
4,882,213 A 11/1989 Gaddis et al.
4,884,303 A 12/1989 Scherer
4,888,828 A 12/1989 Tatsuno
4,892,769 A 1/1990 Perdelwitz et al.
4,894,878 A 1/1990 Roach
4,895,171 A 1/1990 Onik
4,896,387 A 1/1990 Malcolm et al.
4,910,055 A 3/1990 Wigutow
4,972,533 A 11/1990 Brown
4,977,632 A 12/1990 Ong
4,989,282 A 2/1991 Goldstein
5,072,466 A 2/1991 Bond et al.
4,996,733 A 3/1991 Tsai
5,005,235 A * 4/1991 Huang ..... A47G 9/086
2/69.5
5,033,135 A 7/1991 Creek
5,046,204 A 9/1991 Mohler
5,050,254 A 9/1991 Wendy
5,062,168 A 11/1991 Kocib
5,072,465 A 12/1991 Lyons
5,093,947 A 3/1992 Henegar et al.
5,110,383 A 5/1992 Kramer
5,152,017 A 10/1992 Jaeger
5,184,361 A 2/1993 Canter et al.
5,193,235 A 3/1993 Kircher
5,199,121 A 4/1993 Payne
5,287,571 A 2/1994 Rademacher
5,303,435 A 4/1994 Haar et al.
5,327,851 A 7/1994 Pare et al.
5,333,769 A 8/1994 Skroski
5,343,578 A 9/1994 Kettenhofen
5,386,602 A 2/1995 Krenzler
5,386,604 A 2/1995 Ricketts
5,404,600 A 4/1995 DeMars
5,458,146 A 10/1995 Gregg
5,473,779 A 12/1995 Kramer
3,427,431 A 2/1996 Costanzo
5,490,294 A 2/1996 Kramer
5,515,559 A 5/1996 Benson
5,528,781 A 6/1996 Suzuki et al.
5,533,216 A 7/1996 Thier
5,548,858 A 8/1996 Shoa
5,657,497 A 8/1997 Howe
5,699,820 A 12/1997 Evans et al.
5,706,532 A 1/1998 Kettenhofen
D390,686 S 2/1998 Grabowski
5,740,565 A 4/1998 McDade
5,798,166 A 8/1998 Gross
5,881,405 A 3/1999 Garrigues
5,887,299 A 3/1999 Phillips
D412,387 S 8/1999 Frank
5,933,886 A 8/1999 Washington
5,941,264 A 8/1999 Gregg
5,960,492 A 10/1999 Byrne
5,966,756 A 10/1999 Carter
5,996,146 A 12/1999 McPherson
6,009,576 A 1/2000 Gramme
6,018,830 A 2/2000 Howe
6,055,686 A 5/2000 Knight
6,061,831 A 5/2000 Rudolph et al.
6,073,282 A 6/2000 Leeper et al.
6,089,752 A 7/2000 Moore
6,105,168 A 8/2000 Hazen
6,105,188 A 8/2000 Perez et al.
6,122,783 A 9/2000 Herndon
6,128,794 A 10/2000 Pariseau
6,158,068 A 12/2000 Pariseau
6,175,976 B1 1/2001 Cantwell
6,199,232 B1 3/2001 Kocivar
6,202,233 B1 3/2001 Achong
6,216,290 B1 4/2001 Zemitis et al.
6,243,892 B1 6/2001 Kelling
6,279,182 B1 8/2001 Smith
6,292,961 B1 9/2001 Ganio et al.
6,321,400 B1 11/2001 Gulino
6,338,173 B1 1/2002 Ramsey
6,343,968 B1 2/2002 Louie et al.
6,367,083 B1 4/2002 November
6,378,456 B1 4/2002 Jerome
6,393,637 B1 5/2002 Hoffman
6,421,852 B1 7/2002 Shao
6,438,774 B1 8/2002 Michaelis et al.
6,449,787 B1 9/2002 Thorne
6,463,604 B1 10/2002 Reveron et al.
6,543,072 B2 4/2003 Hsu
6,557,192 B2 5/2003 Zheng
6,588,036 B1 7/2003 Hort
6,671,903 B2 1/2004 Bowers et al.
6,704,953 B2 3/2004 Fishman
6,742,225 B2 6/2004 Marty
6,754,918 B1 6/2004 Lap
6,792,631 B1 9/2004 Hayden
6,799,339 B2 10/2004 Stewart
6,839,924 B2 1/2005 Sims
6,859,960 B1 3/2005 Jerome
6,868,566 B2 3/2005 Gatten
6,901,614 B2 6/2005 Holub
6,928,674 B2 8/2005 Blackburn
6,931,680 B2 8/2005 Bellick et al.
6,934,985 B2 8/2005 Sanders
6,964,072 B2 11/2005 Holub et al.
6,964,134 B2 11/2005 Chaffee et al.
6,983,498 B2 1/2006 Peterson et al.
6,986,178 B2 1/2006 Turner
6,990,696 B2 1/2006 Stewart et al.
7,013,507 B2 3/2006 Cook
7,043,783 B2 5/2006 Gatten
7,051,386 B2 5/2006 Stewart et al.
7,051,387 B1 5/2006 Yoder et al.
7,058,997 B1 6/2006 Klinger
7,094,714 B2 8/2006 Lap et al.
7,111,344 B2 9/2006 French
7,127,753 B1 10/2006 Ramaley
7,171,707 B2 2/2007 Landay
7,178,182 B2 2/2007 Brenner et al.
7,181,785 B2 2/2007 Dinan et al.

(56) References Cited

U.S. PATENT DOCUMENTS 7,213,278 B2 5/2007 Peterson et al.
7,263,730 B2 9/2007 Crawford
7,263,731 B1 9/2007 Stepanek et al.
7,328,468 B2 2/2008 Korshamn
7,353,554 B2 4/2008 Wang
7,356,860 B2 4/2008 Yang
7,367,070 B2 5/2008 Akkad
7,386,898 B1 6/2008 Brun
7,395,562 B2 7/2008 Ricketts
7,424,757 B2 9/2008 Paul et al.
7,441,279 B1 10/2008 Lewis
7,472,436 B1 1/2009 Barrett
7,509,695 B2 3/2009 Zheng
7,543,343 B1 6/2009 Hui
7,549,431 B1 6/2009 Farnworth et al.
7,568,245 B2 8/2009 Milam
7,614,099 B2 11/2009 Goetz
7,614,100 B1 11/2009 Barrington et al.
7,614,104 B2 11/2009 Wang et al.
7,631,376 B2 12/2009 Peterson et al.
7,631,377 B1 12/2009 Sanford
7,636,962 B2 12/2009 Zheng
7,647,656 B2 1/2010 Smith
7,650,655 B2 1/2010 Narboni-Campora et al.
7,752,690 B1 7/2010 Seth
7,774,875 B1 8/2010 Zeidman
7,802,844 B1 9/2010 Vencill
7,818,833 B2 10/2010 Ewing
7,818,834 B2 10/2010 Li
7,832,032 B2 11/2010 Haislip
7,845,031 B2 12/2010 Tatsuno
7,849,534 B2 12/2010 Bellick et al.
7,849,535 B2 12/2010 Tatsuno
7,900,301 B2 3/2011 Tatsuno
8,024,827 B2 3/2011 Ricketts
7,954,185 B2 6/2011 NarboniCampora et al.
7,987,536 B1 8/2011 Habig et al.
8,051,509 B2 11/2011 Sikui et al.
8,057,878 B2 11/2011 Lo et al.
8,166,572 B1 5/2012 Campbell et al.
8,278,227 B2 10/2012 Shibaoka et al.
2002/0078501 A1 6/2002 Lamke
2002/0083525 A1 7/2002 Zheng
2002/0100120 A1 8/2002 Hsu
2002/0104162 A1 8/2002 Stewert
2002/0133879 A1 9/2002 Smith et al.
2002/0170112 A1 11/2002 Bowers
2002/0174484 A1 11/2002 Gotfried
2003/0079283 A1 5/2003 Vann
2003/0101511 A1 6/2003 Gotfried
2003/0106150 A1 6/2003 Chyi
2003/0135924 A1 7/2003 Chuang
2003/0182724 A1 10/2003 Zheng
2003/0188382 A1 10/2003 Klamm et al.
2003/0226205 A1 12/2003 Fishman
2004/0019968 A1 2/2004 Vlassis et al.
2004/0019969 A1 2/2004 Gatten
2004/0025929 A1 2/2004 Turner
2004/0040087 A1 3/2004 Lack et al.
2004/0055117 A1 3/2004 Marty et al.
2004/0107500 A1 6/2004 Pigg
2004/0123385 A1 7/2004 Lamke
2004/0158925 A1 8/2004 Sims
2004/0216230 A1 11/2004 Blackburn
2004/0237192 A1 12/2004 Holub et al.
2005/0028276 A1 2/2005 Holub et al.
2005/0034234 A1 2/2005 Bellick et al.
2005/0034235 A1 2/2005 Bellick et al.
2005/0125895 A1 6/2005 Gatten
2005/0159056 A1 7/2005 Lap et al.
2005/0172401 A1 8/2005 Akkad
2005/0177939 A1 8/2005 Botera et al.
2005/0188461 A1 9/2005 Peterson et al.
2005/0210583 A1 9/2005 Cook
2005/0210585 A1 9/2005 French
2006/0053552 A1 3/2006 Peterson et al.
2006/0075554 A1 4/2006 Zheng
2006/0137093 A1 6/2006 Dinan et al.
2006/0150328 A1 7/2006 Nguyen
2006/0162072 A1 7/2006 Tenenbaum et al.
2006/0185085 A1 8/2006 Brenner et al.
2006/0207024 A1 9/2006 Korshamn
2006/0230533 A1 10/2006 Liang
2006/0260046 A1 11/2006 Landay
2006/0260047 A1 11/2006 Peterson et al.
2006/0277680 A1 12/2006 Goetz
2007/0028952 A1 2/2007 Woodruff et al.
2007/0044236 A1 3/2007 Tatsuno
2007/0061964 A1 3/2007 Seth
2007/0061965 A1 3/2007 Crawford
2007/0061966 A1 3/2007 Seth
2007/0113340 A1 5/2007 Yang
2007/0136946 A1 6/2007 Haislip
2007/0199148 A1 8/2007 Ricketts
2007/0226903 A1 10/2007 Paul et al.
2007/0245490 A1 10/2007 Oh
2008/0028518 A1 2/2008 Miotke et al.
2008/0028519 A1 2/2008 Traynor
2008/0047062 A1 2/2008 Wang
2008/0052826 A1 3/2008 Stapley
2008/0078027 A1 4/2008 Smith
2008/0092301 A1 4/2008 Wang et al.
2008/0098522 A1 5/2008 Milam
2008/0142060 A1 6/2008 Orth et al.
2008/0148480 A1 6/2008 Narboni-Campora et al.
2008/0189855 A1 8/2008 Zheng
2008/0209688 A1 9/2008 Palmer et al.
2008/0214332 A1 9/2008 Zheng
2008/0216234 A1 9/2008 Tatsuno
2008/0216238 A1 9/2008 Tatsuno
2008/0222803 A1 9/2008 Korshamn
2008/0229499 A1 9/2008 Narboni-Campora et al.
2008/0256705 A1 10/2008 Maguire
2009/0031501 A1 2/2009 Huang
2009/0044333 A1 2/2009 Colleran et al.
2009/0049658 A1 2/2009 Takasawa et al.
2009/0056015 A1 3/2009 Montgomery
2009/0113628 A1 5/2009 Hui
2009/0151071 A1 6/2009 Martin
2009/0178196 A1 7/2009 Zheng
2009/0255059 A1 10/2009 Ascroft et al.
2009/0276956 A1 11/2009 Ewing
2009/0297798 A1 12/2009 Tsai
2010/0024125 A1 2/2010 Li
2010/0024126 A1 2/2010 Sikui et al.
2010/0024701 A1 2/2010 Li
2010/0031413 A1 2/2010 Jensen
2010/0032459 A1 2/2010 Clark et al.
2010/0078456 A1 4/2010 Mottram et al.
2010/0086730 A1 4/2010 Lo et al.
2010/0107333 A1 5/2010 Ortlieb
2010/0175188 A1 7/2010 Narboni-Compora et al.
2010/0192298 A1 8/2010 Michaelis et al.
2010/0242172 A1 9/2010 Lijesen et al.
2010/0256716 A1 10/2010 Haislip
2011/0023233 A1 2/2011 Hilgeman
2011/0094004 A1 4/2011 Li
2011/0113550 A1 5/2011 Lafoux
2011/0173737 A1 7/2011 Lawver
2011/0173749 A1 7/2011 Martray
2011/0185498 A1 8/2011 Ricketts
2011/0274869 A1 11/2011 Bemhard et al.
2011/0302689 A1 12/2011 Tone et al.
2011/0311603 A1 12/2011 Lucas
2012/0031448 A1 2/2012 Brensinger et al.
2012/0096641 A1 4/2012 McGuire et al.
2012/0151654 A1 6/2012 Chopak et al.
2012/0180213 A1 7/2012 Storms
2012/0204348 A1 8/2012 Bayer
2012/0251597 A1 10/2012 Gupta et al.
2012/0255125 A1 10/2012 Brown

* cited by examiner

SLEEPING BAG WITH BLANKET

CROSS REFERENCE TO RELATED APPLICATION

This application claims priority to U.S. Provisional Patent Application Ser. No. 62/194,930, filed on Jul. 21, 2015, which is incorporated in its entirety by reference.

BACKGROUND

The disclosure relates generally to sleeping bags, and more particularly, to sleeping bags having an inner blanket selectively moveable from a closed configuration to an opened configuration relative to an inner volume of the sleeping bags.

Typically, sleeping bags are used when conventional bed and bedding are unavailable. For example, sleeping bags are used by backpackers, hikers, campers, mountaineers, and other users as portable beds or coverings. Sleeping bags are often durable sleeping coverings that provide a soft surface, insulation, and weather resistance.

Consumers may face a difficult task in finding a sleeping bag that is thermally efficient, comfortable, and lightweight. One type of sleeping bag is referred to as a "mummy bag", which tends to be shaped with a lateral taper to approximate the contour of the body of a user and thereby minimize the internal volume of the bag. Mummy bags attempt to conserve heat by minimizing air movement within and from the bag. As a result, mummy bags are often suited for use in outdoor, colder ambient temperatures. For some conventional mummy bags, users may feel discomfort due to the tight fit of the bag. Some users may become too warm or the air within the bag may become stagnant. Such feeling of discomfort may be increased in the body portion of the bag due to the length relative to the rest of the bag. Thus, some users may be unable to sleep comfortably in mummy bags.

Moreover, mummy bags typically have a small generally elliptical opening suitable for a user's head to protrude from during use. In order to enter typical mummy bags, a user must unzip the bag, and then get inside the bag. Due to the tight fit, the user may find it difficult to fully zip the bag, and furthermore, the zipped bag may be uncomfortable. An additional drawback to the mummy bag is that the tight fit of the bag may reduce the range of motion of the user of the bag. Such feeling of discomfort may be increased in parts of the user's body that are often moved during sleep such as the arms and legs of the user.

Other sleeping bags, such as rectangular-type sleeping bags, are shaped with a generally constant lateral dimension and provide a greater range of motion for the user. Such bags also typically have a zippered portion to allow the user to more easily enter the bag. Although rectangular bags are often more spacious than mummy bags, a drawback is that the larger internal volume may reduce the thermal efficiency of the bag. Moreover, rectangular bags often do not insulate the head, and are typically too large to be thermally efficient. As a result, rectangular bags tend to be better suited for use indoors or in milder outdoor temperatures. Although thermally different than mummy bags, rectangular-type sleeping bags may also become too warm or the air within the bag may become stagnant.

Accordingly, a need exists for a sleeping bag that can easily, and efficiently adapt to differing temperatures experience by the user during use of the sleeping bag. Additionally, a need exists for sleeping bag that provides different and movable layers for the user. Moreover, a need exists for a sleeping bag that is both comfortable, thermally efficient, and allows the warm, stagnant air within the bag to escape and be replaced with fresh, ambient air. Still further, a need exists for a sleeping bag that facilitates a greater range of motion for the user.

SUMMARY

In one aspect, a sleeping bag is provided. The sleeping bag includes an elongate shell defining a longitudinal centerline and an inner volume sized and shaped to receive a user therein, the shell having a head portion, a foot portion, a middle portion extending longitudinally between the head and foot portions, an overlying portion adapted to overlie the user during use, and an underlying portion adapted to underlie the user during use. A blanket is coupled to the shell and configured to selectively move between a closed position within the inner volume and an open position beyond the shell.

In another aspect, a sleeping bag is provided. The sleeping bag includes an elongate shell defining an inner volume sized and shaped to receive a user therein, the shell having an overlying portion adapted to overlie the user during use, and an underlying portion adapted to underlie the user during use. A blanket is coupled to the shell and configured to selectively move between a closed position within the inner volume and an open position beyond the shell. Moreover, the sleeping bag includes a draft flap coupled to the blanket.

In yet another aspect, a blanket for use with a sleeping bag is provided. The blanket includes a base layer having a first end, a second end, a body extending between the first end and the second end; and a zipper coupled to the base layer and having a first zipper end and a second zipper end, wherein the first end is configured to extend beyond the first zipper end.

In a further aspect, a method of manufacturing a blanket is provided. The method includes forming an elongate shell defining a longitudinal centerline and an inner volume sized and shaped to receive a user therein, the shell having a head portion, a foot portion, a middle portion extending longitudinally between the head and foot portions, an overlying portion adapted to overlie the user during use, an underlying portion adapted to underlie the user during use. The method also includes coupling a blanket to the shell and configured to selectively move between a closed position within the inner volume and an open position beyond the shell. A draft flap is coupled to the blanket.

BRIEF DESCRIPTION OF THE DRAWINGS

Features, aspects, and advantages of the present disclosure will become better understood when the following Detailed Description is read with reference to the accompanying drawings in which like characters represent like parts throughout, wherein.

DETAILED DESCRIPTION

The embodiments described herein relate to a sleeping bag that can easily, economically and efficiently adapt to differing temperatures and/or differing body arrangements experienced by the user during use of the sleeping bag. Moreover, the embodiments relate to a sleeping bag that is both comfortable, thermally efficient, and allows the warm, stagnant air within the bag to escape and be replaced with fresh, ambient air. Still further, the embodiments described herein relate to a blanket that can be selectively used in combination with an overlying portion to adapt to differing temperatures and/or to different body arrangements of the user within the sleeping bag to facilitate a greater range of motion for the user within the sleeping bag. The embodiments further describe a blanket that can provide an additional padded area next to the sleeping bag. The embodiments provide that the user can sleep using an overlying portion and the blanket, or only the blanket, or no covering at to provide different amounts or warmth or selective amounts of warmth as the user's body temperature fluctuates during use of the sleeping bag and/or as the temperature of the environment fluctuates during use of the sleeping bag. Moreover, the embodiments provide for an opening in the front of the sleeping allowing the user to vent their feet as needed.

Figure 1:
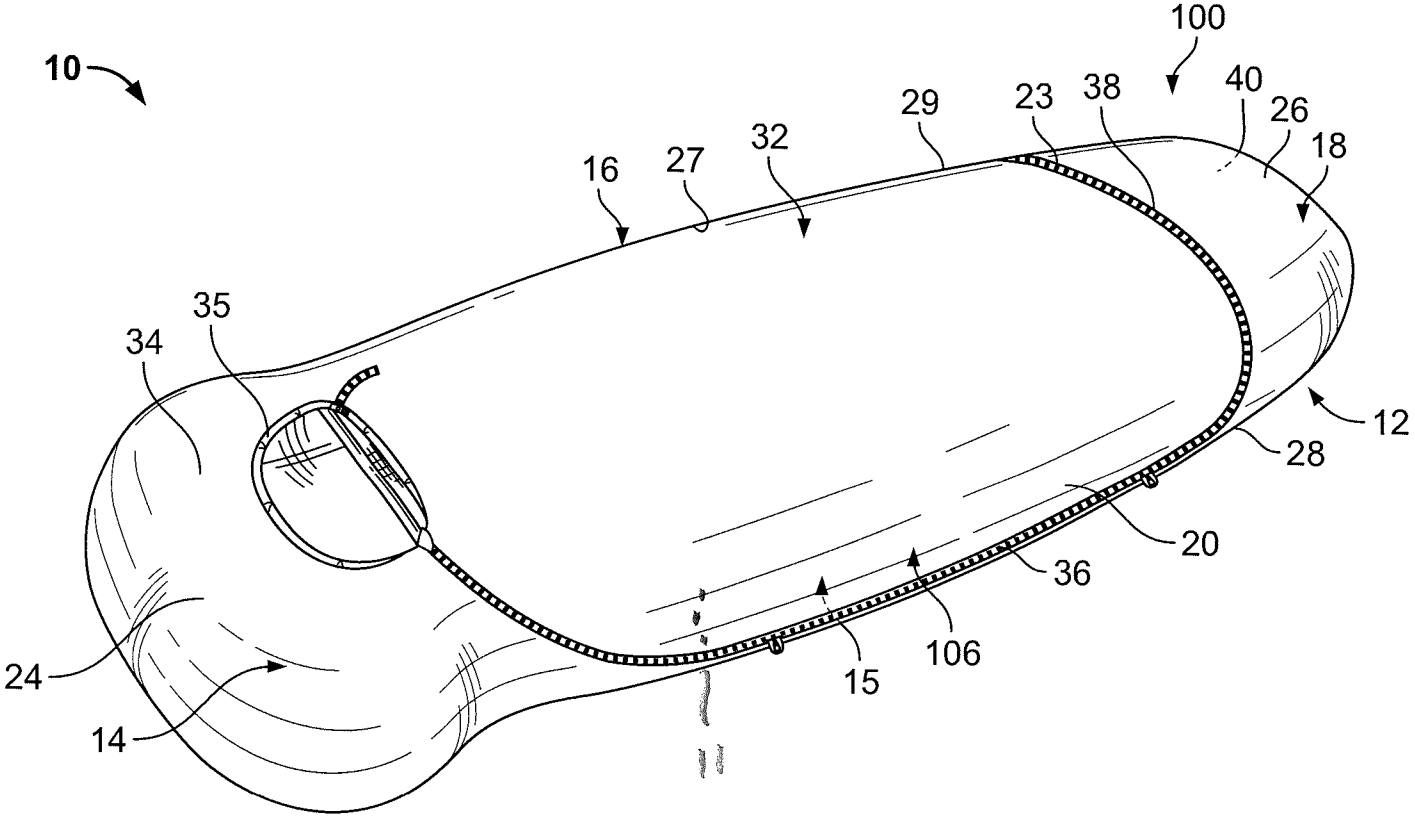
FIG. 1 is a plan view of an exemplary sleeping bag in a first position and having an exemplary blanket coupled thereto.
Figure 2:
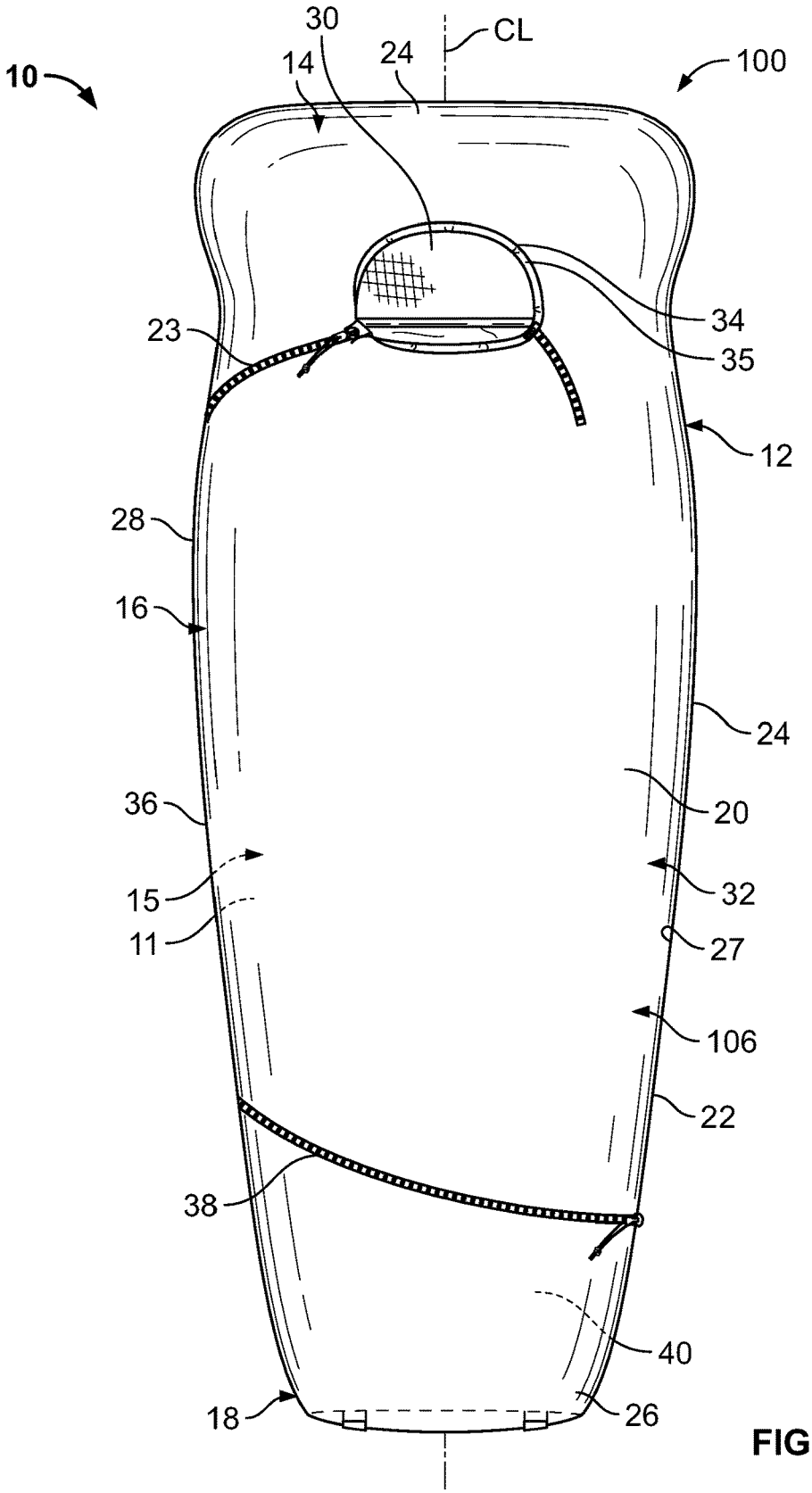
FIG. 2 is a plan view of the sleeping bag and the blanket in the first position.
Figure 3:
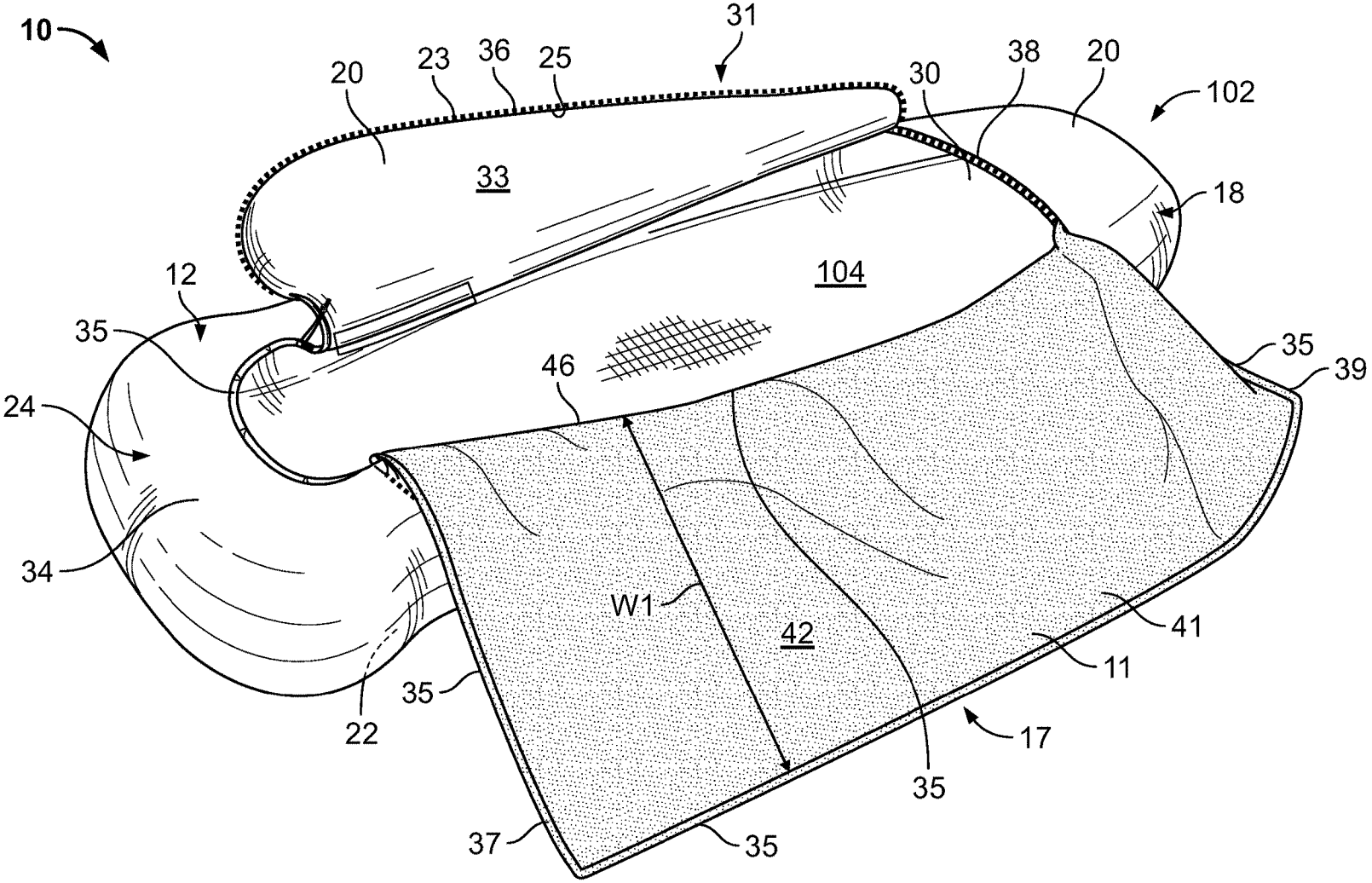
FIG. 3 is a perspective view of the sleeping bag and the blanket in a second position.
Figure 4:
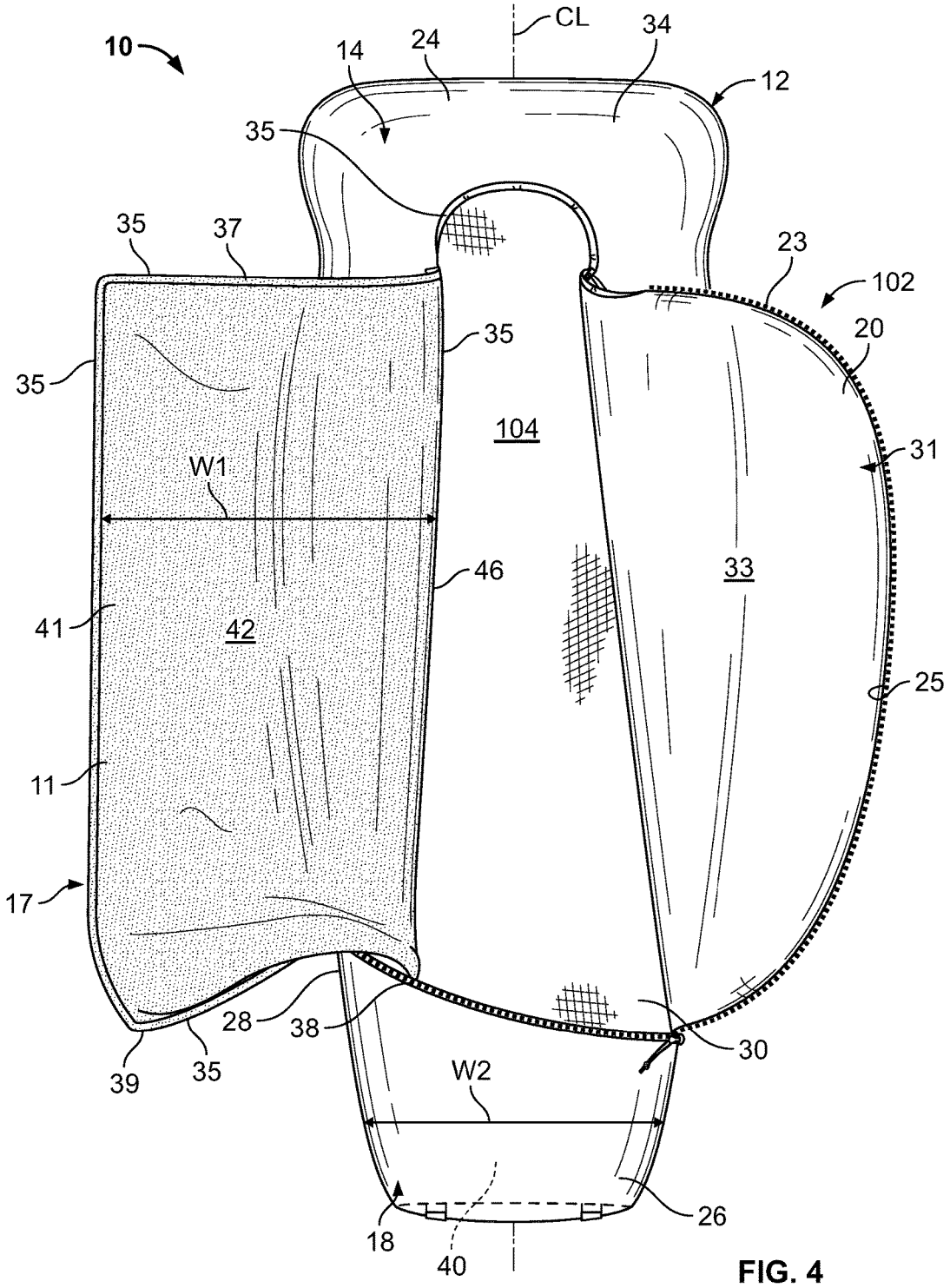
FIG. 4 is a plan view of the sleeping bag and the blanket in the second position.

FIG. 1 is a perspective view of a sleeping bag 10 in a first position or overall closed position 100 and a blanket 11 coupled thereto. FIG. 2 is a plan view of the sleeping bag 10 and the blanket 11 in the first position 100. FIG. 3 is a perspective view of the sleeping bag 10 and the blanket 11 in a second position or overall open position 102. FIG. 4 is a plan view of the sleeping bag 10 and the blanket in the second position 102. In the exemplary embodiment, the blanket 11 is integrally coupled to the sleeping bag 10 by a fastener such as, but not limited to, a stitched seam. The sleeping bag 10 comprises an elongate shell 12 that defines an inner volume 104 that is sized and shaped to receive a user (not shown) therein. The shell 12 has a head portion 14, a foot portion 18, and a middle portion 16 that extends longitudinally between the head portion 14 and foot portion 18. In addition, the shell 12 has an overlying portion 20 that is configured to overlie the user and an underlying portion 22 that is configured to underlie the user during use of the sleeping bag 10.

In the exemplary embodiment, the sleeping bag 10 includes a first fastener 23 such as, but not limited to a first zipper configured to selectively attach and detach at least a portion of the overlying portion 20 to at least a portion of the shell 12. In the illustrated embodiment, the sleeping bag 10 is a "regular" size sleeping bag configured to fit users having a variety of sizes and shapes. It is understood, however, that the sleeping bag 10 may have any suitable size (for example, shorter, longer, wider, narrower) and may be configured specifically for men, women, or youths. Moreover, the sleeping bag 10 may have a plurality of thermal compositions dispensed or dispersed through the sleeping bag 10 to accommodate for a variety of the user's body temperatures and/or temperatures of the environment. It is also contemplated that the sleeping bag 10 can be sized and shaped to receive more than one individual (for example, two individuals).

In the illustrated embodiment, the shell 12 comprises a head end panel 24 located in the head portion 14, a foot end panel 26 located in the foot portion 18, a first side panel 28, and a second side panel 29 located in the middle portion 16. The side panels 28, 29 extend longitudinally between the head end panel 24 and the foot end panel 26 and are symmetrical about a longitudinal centerline CL of the sleeping bag 10. The head end panel 24, the foot end panel 26, and the side panels 28, 29 are stitched into the shell 12 between the overlying portion 20 and underlying portion 22. As a result, the panels 24, 26, 28, 29 collectively provide vertical expansion of the shell 12, thus adding inner volume to the sleeping bag 10. It is contemplated that in some embodiments, the panels 24, 26, 28, 29 can be omitted. In the exemplary embodiment, the first zipper 23 is configured to removably couple a side 25 of the overlying portion 20 to the first side panel 28. Moreover, another side 27 of the overlying portion 20 is integrally coupled to the second side panel 29 by, for example only, stitching to the second side panel 29. Alternatively, the first zipper 23 can couple the overlying portion 20 to the second side panel 29.

In the illustrated embodiment, the shell 12 is tapered toward the foot portion 18 to generally conform to the contours of the user, being broadest in the head portion 14 corresponding to the shoulders of the user and narrowest in the foot portion 18 corresponding to the feet of the user. The tapered shell 12 thus provides the user a generally snug fit. By generally conforming to the contours of the user and substantially receiving the user therein, air movement within the sleeping bag 10 is substantially reduced, thus making the bag thermally efficient. The illustrated sleeping bag 10 can be generally categorized as a semi-rectangular bag or a tapered bag. It is understood, however, that in other embodiments the sleeping bag 10 could have less taper (for example, a rectangular-type bag) or have greater taper (for example, a mummy type bag).

The shell 12 comprises an inner layer 30 that defines the inner volume 104 of the shell 12 and an outer layer 32 that defines an exterior of the shell 12. The inner layer 30 is configured to receive the user occupying the inner volume 104 of the sleeping bag 10. The inner and outer layers 30, 32 can be any suitable material (for example, polyester). In some embodiments, the inner layer 30 can be made from a material different than the outer layer 32. The shell 12 also comprises an insulation material (not shown) that is located between the inner layer 30 and the outer layer 32 to facilitate providing warmth and softness to the sleeping bag 10. The insulation material can be attached to the inner and outer layers 30, 32 of the shell 12 using stitch-lines. It is understood that the insulation material can be any suitable material (for example, goose down, CLOUDLOFT™ insulation, DRIDOWN™ insulation) and that the amount of insulation material can be selected to achieve the desired warmth and softness. The inner and outer layers 30, 32 are stitched together along their periphery edges to enclose the insulation material between the layers 30, 32.

In one suitable embodiment, the sleeping bag 10 has a hood 34 located at the head portion 14 of the shell 12. The hood 34 is configured to receive a pillow and/or the head of the user. Moreover, the head portion 14 of the shell 12 includes a support member 35 disposed adjacent to the head end panel 24 and extending from one of the side panels 28, 29 to the other. The support member 35 is attached (for example, by stitching) along three of its edges to the shell 12. Specifically, the support member 35 is attached at its edges to each of the side panels 28, 29 and the head end panel 24. The support member 35 is configured to provide support to the head portion 14 of the shell 12 such that the side panels 28, 29 and head end panel 24 of the shell 12 do not collapse.

In the illustrated embodiment, the support member 35 is made from the same material as the shell 12 (i.e., an inner layer, an outer layer, and an insulation material between the inner and outer layers) but it is understood that the support member 35 can be made from any suitable material or materials. The illustrated support member 35 has a generally constant width along its length. It is understood however that the width of the support member 35 can vary along its length, for example, to conform to the contours of the sleeping bag 10.

The overlying portion 20 is configured to rotatably move about the second side panel 29 and toward and away from the first side panel 28. Moreover, the overlying portion 20 is configured to move into the inner volume 104 in a closed overlying position 106 (FIGS. 1 and 2) and out of the inner volume 104 in an open overlying position 31 (FIGS. 3 and 4). In the open overlying position 31, the overlying portion 20 can move relative to the first side panel 28 to selectively expose the blanket 11 and/or the inner volume 104. Still further, in the open overlying position 31, the overlying portion 20 is configured to move about the second side panel 29 and extend away from the shell 12. In this open overlying position 31, the overlying portion 20 is configured to facilitate providing an additional padding area 33 next to the shell 12. Accordingly, the padding area 33, defined by the extended overlying portion 20, can provide a lay-down area for food or equipment or can provide an additional padded rest area for the user.

In the closed overlying position 106, the first zipper 23 can couple the overlying portion 20 to at least one of the head portion 14, the middle portion 16, and/or the foot portion 18. The first zipper 23 includes a straight portion 36 positioned longitudinally along the middle portion 16 and a curved portion 38 positioned transversely across the foot portion 18. More particularly, the straight portion 36 is substantially parallel to the longitudinal centerline CL and the curved portion 38 is substantially perpendicular to the longitudinal centerline CL. The curved portion 38 is configured to facilitate forming a foot volume 40 regardless if the overlying portion 20 is in the closed overlying position 106, the open overlying position 31, and/or selected positions in between the closed overlying position 106 and the open overlying position 31. The foot volume 40 facilitates providing selective placement of the user's feet within the foot portion 18 during different positions of the overlying portion 20.

In the exemplary embodiment, the blanket 11 is coupled to the shell 12 and is configured to selectively move between a blanket closed position 15 and within the inner volume 104 (shown in FIGS. 1 and 2), partially within or over the inner volume 104 (shown in FIG. 5), and/or a blanket open position 17 which is configured out of the inner volume 104 (shown in FIGS. 3, 4, 5, and 6). The open position 17 can also include positioning the blanket 11 beyond the shell 12. The blanket 11 includes a blanket thermal compositions which can be the same or different than the thermal composition of the shell 12 and/or the overlying portion 20.

In an embodiment, the blanket 11 is generally rectangular. Alternatively, the blanket 11 can include other shapes. For the rectangular configuration, the blanket 11 has four side edges 35. Moreover, the blanket 11 includes a first end 37, a second end 39, and a body 41 located between the first end 37 and the second end 39 and disposed within the four side edges 35. Two of the side edges 35 extend longitudinally with respect to the shell 12, and the other two side edges 35 extend transversely with respect to the shell 12.

In an embodiment, the blanket 11 has a width W1, for example a distance between the longitudinally extending side edges 35, greater than a width W2 of the shell 12. As a result, the longitudinally extending edges 35 of the blanket 11 can be capable of extending transversely beyond the extent of the first side panel 28 and/or the second side panel 29 in the blanket open position 17. More particularly, in an embodiment, the blanket 11 is configured to extend beyond the shell 12 and at least partially overlie the overlying portion 20. The blanket 11 can overlie the overlying portion 20 which can be positioned in the closed overlying position 106 and the open overlying position 31. The blanket 11 is also configured to rotate about the first side panel 28 and extend away from the shell 12. In this open position, the blanket 11 is configured to facilitate providing an additional padding layer area 42 next to the shell 12. Accordingly, the padding area 42 defined by the extended blanket 11 can provide a lay-down area for food or equipment or can provide an additional padded rest area for the user. Additionally, in the illustrated embodiment, the blanket 11 has a length, for example, the distance between the first end 37 and the second end 39, which is less than a length of the shell 12. Still further, in an exemplary embodiment, a draft flap 46 is coupled to the blanket 11. The draft flap 46 can be removably coupled to the blanket 11 or integrally coupled to the blanket 11. More particularly, the draft flap 46 is positioned between the underlying portion 22 and the blanket 11.

Figure 5:
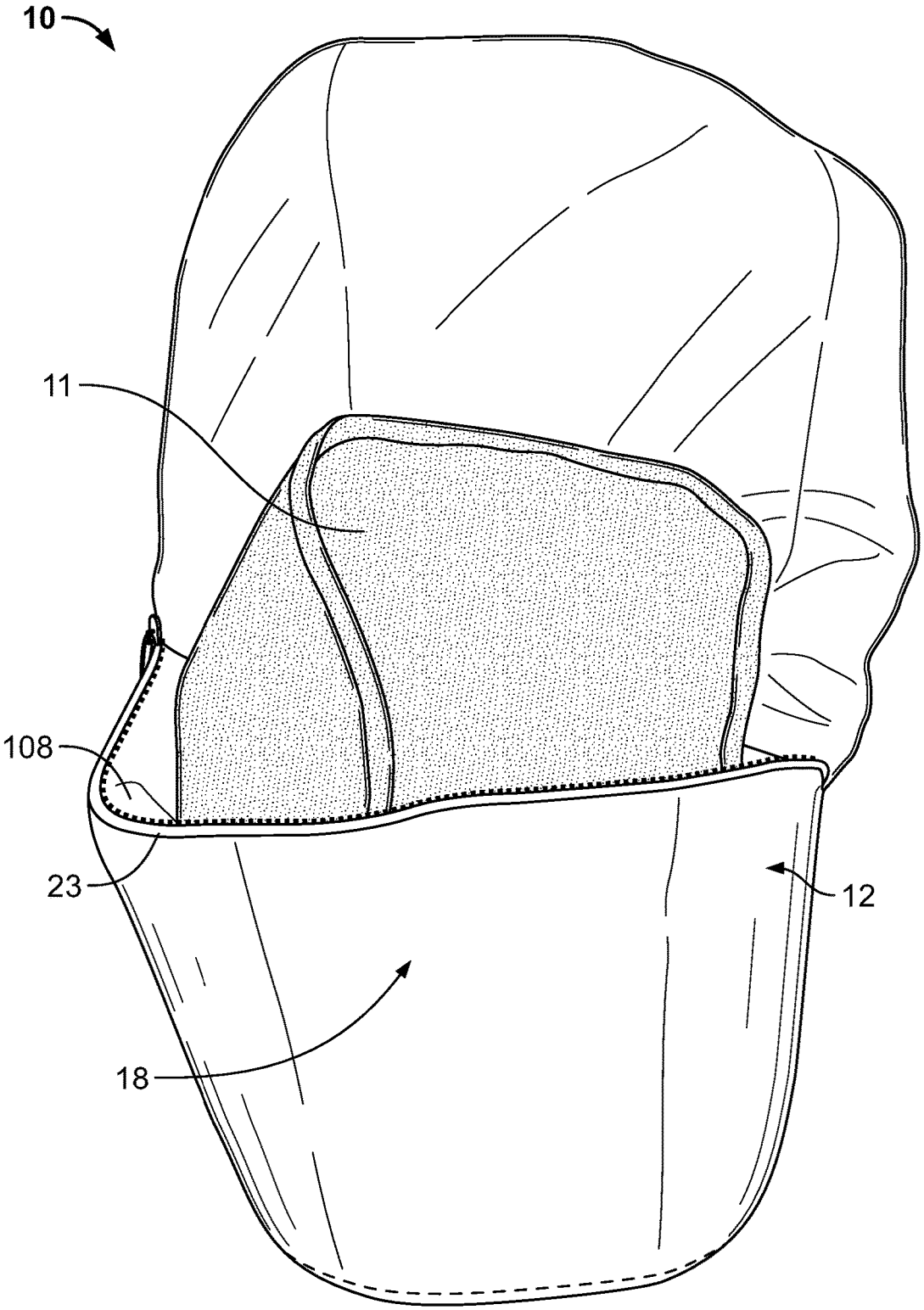
FIG. 5 is a plan view a plan view of the sleeping bag having an opening and the blanket extending through the opening.

FIG. 5 is a plan view of the sleeping bag 10 and an opening 108 selectively formed there through. The zipper 23 is configured to form the selectively sized opening 108 through the shell 12. In the exemplary embodiment, the zipper 23 is configured to selectively form the opening 108 in the foot portion 18. The opening 108 is sized and shaped to allow the user's feet to extend through the opening 108 and out of the shell 12 to facilitate selective cooling and/or comfort for the user's feet. Additionally, the opening 108 is sized and shaped to allow the blanket 11 to extend through the opening 108 and out of the shell 12 to facilitate selective cooling and/or comfort for the user's feet.

Figure 6:
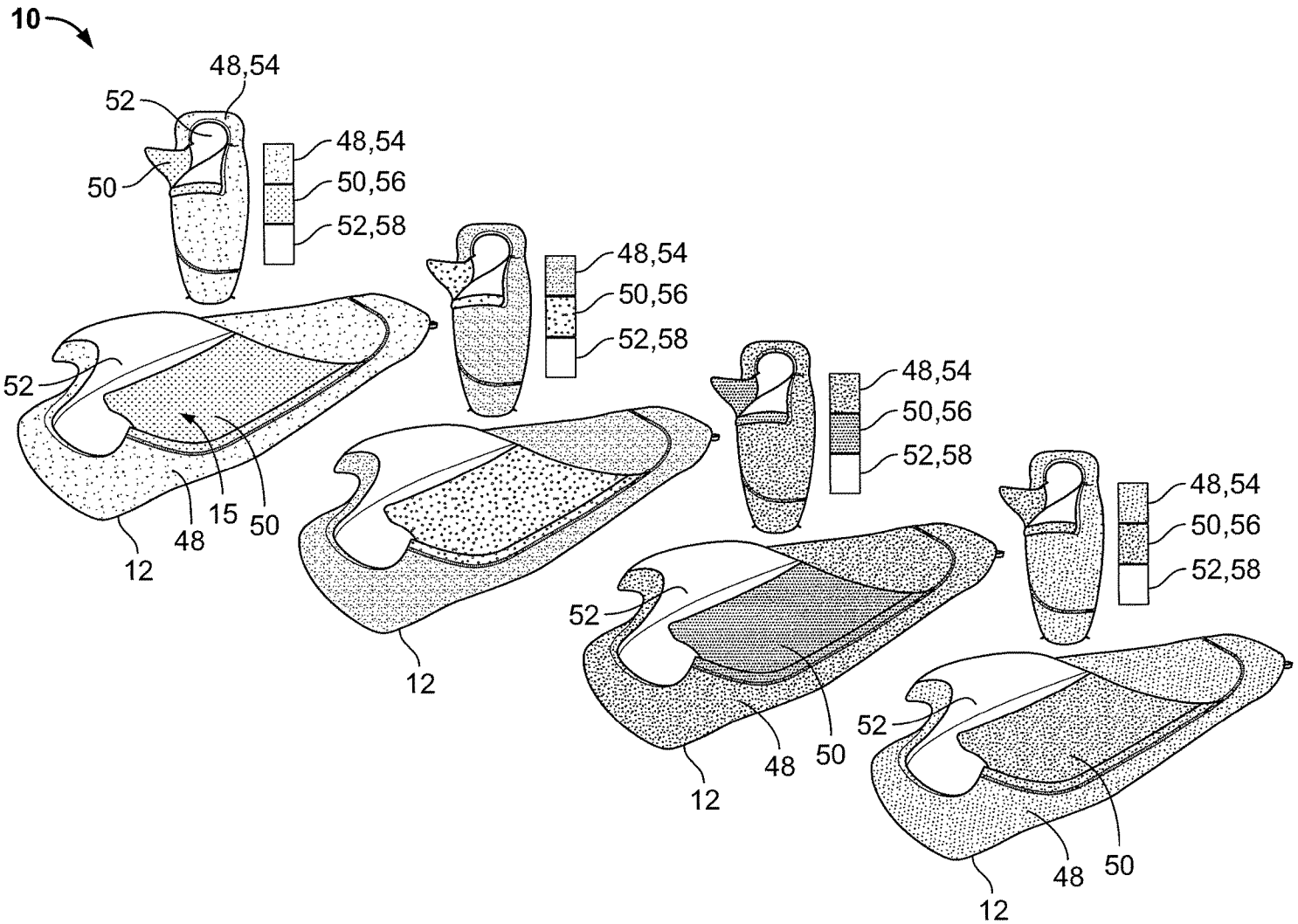
FIG. 6 is a perspective view of a plurality of exemplary sleeping bags with different portions having a plurality of colors and/or material compositions.

FIG. 6 is a perspective view of a plurality of sleeping bags 10 with different portions having a plurality of colors and/or material compositions. More particularly, in the exemplary embodiment, the shell 12 has a first color 48, the overlying portion 20 has a second color 50, and the blanket 11 has a third color 52. The first color 48, the second color 50, and the third color 52 can be different from each other to provide a visual difference to the user for the different portions. The differing color schemes facilitate the user locating and moving the preferred overlying portion 20 or blanket 11 in low light conditions. Alternatively, any one of or all of the first color 48, the second color 50, and the third color 52 can be the same. Additionally, in an embodiment, the shell 12 has a first composition 54, the overlying portion 20 has a second composition 56, and the blanket 11 has a third composition 58. The first composition 54, the second composition 56, and the third composition 58 can be different from each other to provide different thermal layers for the user. Alternatively, any one of or all of the first composition 54, the second composition 56, and the third composition 58 can be the same.

During an exemplary use, the user can selectively use or position the overlying portion 20 and the blanket 11 relative to the shell 12, individually or in combination, to accommodate for different temperatures experienced of the user's body and/or different temperatures of the environment. Additionally, the user can selectively use or position the overlying portion 20 and the blanket 11 relative to the shell 12, individually or in combination to accommodate for different sleeping arrangements by the user. More particularly, the overlying portion 20 and the moveably blanket facilitate providing different and movable portions to allow the user to sleep comfortably on their back, side, or stomach. As noted, FIGS. 1 and 2 are views of the sleeping bag 10 in the first position 100. In the first position 100, the blanket 11 is positioned between overlying portion 20 and the inner layer 30. Alternatively, in the first position 100, the overlying portion 20 can be positioned between the blanket 11 and the inner layer 30.

FIGS. 3 and 4 are views showing the sleeping bag 10 in the second position 102. In the second position 102, the blanket 11 is selectively moved relative to the first side panel 28 and to the blanket open position 17 to expose or partially expose the inner layer 30 and/or the inner volume 104. Moreover, in the second position 102, the overlying portion 20 is selectively moved about the second side panel 29 and to the open overlying position 31 to expose or partially expose the inner layer 30 and/or the inner volume 104. In the second position 102, the inner layer 30 and/or the inner volume 104 is exposed to the environment to allow warm or stagnant air to escape and expose fresh or ambient air to the inner layer 30 and/or the inner volume 104.

Figure 7:
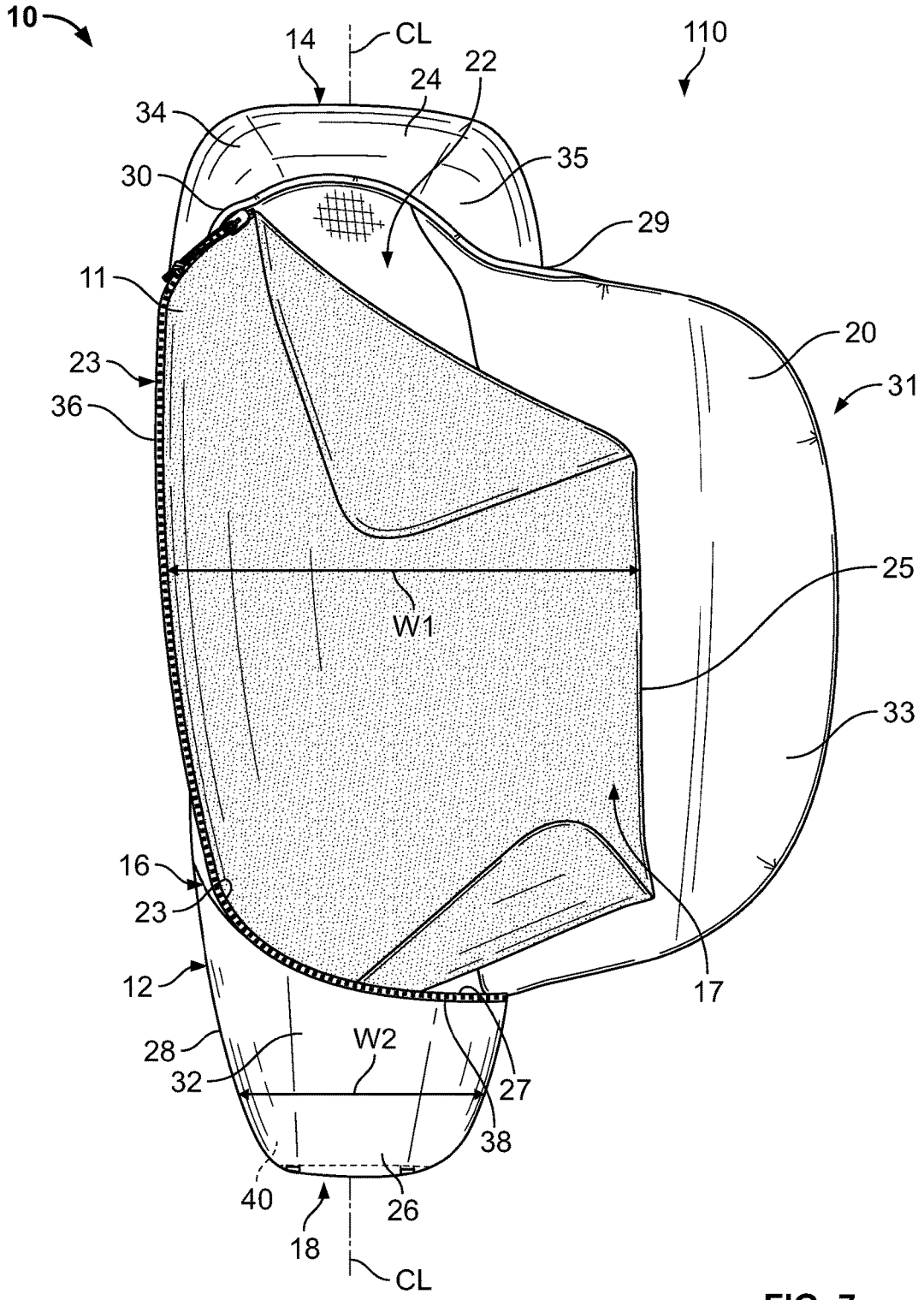
FIG. 7 is a plan view of the sleeping bag and the blanket in a third position.

FIG. 7 is a plan view showing the sleeping bag 10 in a third position 110. In the third position 110, the overlying portion 20 is selectively moved to the open overlying position 31 wherein the overlying portion 20 is almost fully or fully disposed outside of the inner volume of the shell 12. In this open position, the overlying portion 20 is pivoted almost 180 degrees about the second side panel 29. In this open position, the overlying portion 20 exposes or partially exposes the inner volume 104 to the environment. Moreover, the overlying portion 20 in the open overlying position 31 exposes or partially exposes the blanket 11 in the blanket closed position 15. In the open overlying position 31, the inner volume 104 is substantially free of the overlying portion 20 when the overlying portion 20 is moved to the overlying open position 31.

The blanket 11 can be selectively moved from the blanket closed position 15 wherein the blanket 11 is disposed within the inner volume 104 of the shell 12, and the blanket open position 17, wherein the blanket 11 is at least partially disposed outside the inner volume 104 of the shell 12. In the blanket closed position 15, the blanket 11 at least partially closes the inner volume 104 as exposed by the overlying portion 20 when the overlying portion 20 is positioned in the open overlying position 31. The blanket 11 blocks or otherwise inhibits air flow through the sleeping bag 10 and into the inner volume 104 of the shell 12. Moreover, since the width W1 of the blanket 11 is longer than the width W2 of the shell 12, in the blanket closed position 15, the blanket 11 can extend beneath the overlying portion 20 and the second side panel 29. Additionally, since the width W1 of the blanket 11 is longer than the width W2 of the shell 12, in the blanket open position 17, the blanket 11 can extend beyond the second side panel 29 and at least partially cover the overlying portion 20.

Figure 8:
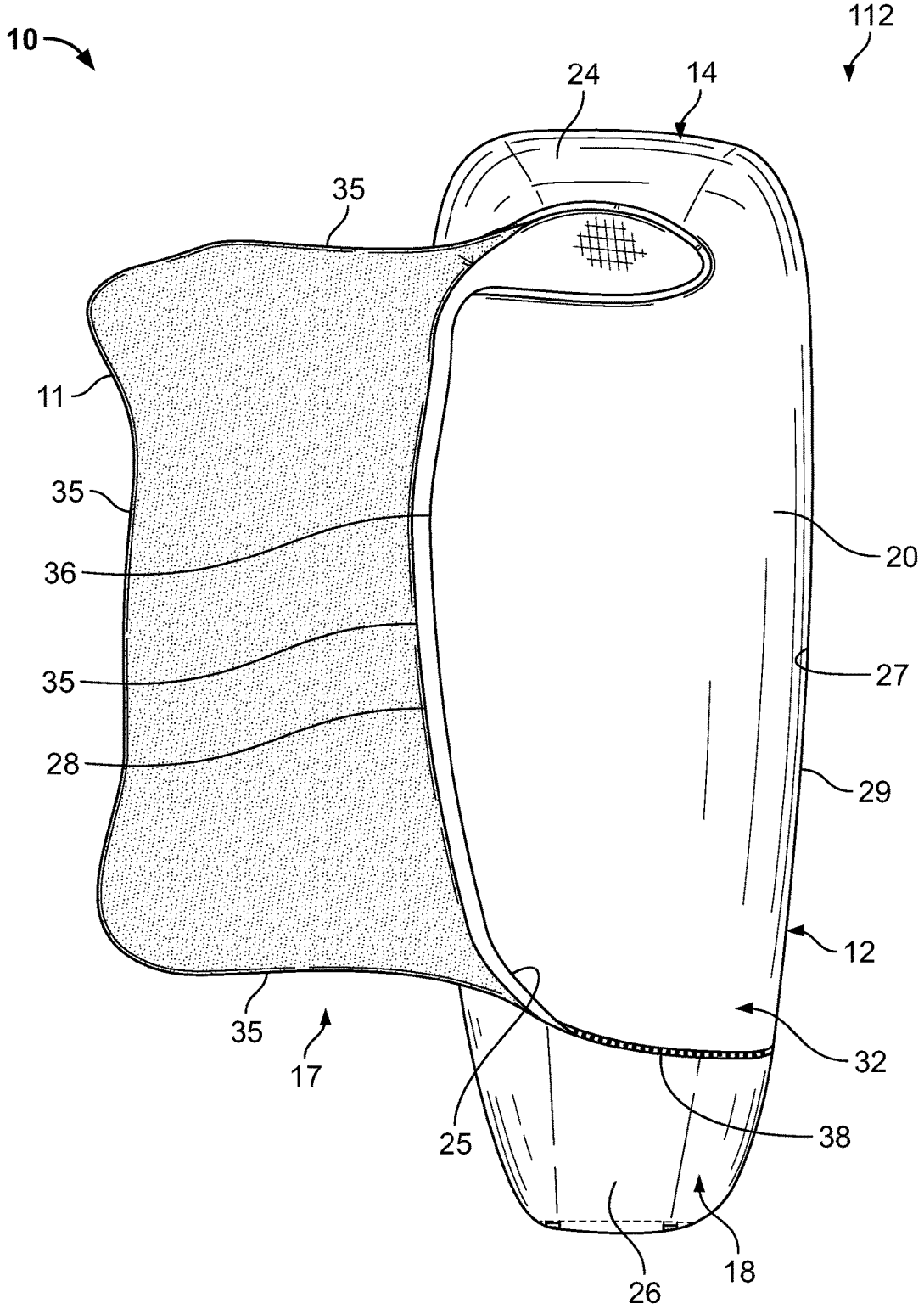
FIG. 8 is a plan view of the sleeping bag and the blanket in a fourth position.

FIG. 8 is a plan view of the sleeping bag 10 in a fourth position 112. In the fourth position 112 the blanket 11 is selectively moved relative to the first side panel 28 and the blanket open position 17 to expose or partially expose the inner layer 30 and/or inner volume 104. Moreover, in the fourth position 112, the overlying portion 20 is selectively moved about the second side panel 29 to the closed overlying position 106 to cover or partially cover the inner layer 30 and the inner volume 104.

To accommodate for varying temperatures, the user selectively moves and uses the overlying portion 20 and the blanket 11. For colder temperatures, the user can move the overlying portion 20 and blanket 11 to respective closed positions. For warmer temperatures, the user can move the overlying portion 20 to the open overlying position 31 and keep the blanket 11 in the blanket closed position 15 for thermal comfort selection and/or body arrangement selection within the shell 12. Alternatively, the user can move the blanket 11 to the blanket open position 17 and keep the overlying portion 20 in the overlying closed position 106 for a different thermal comfort selection and/or body arrangement selection within the shell 12. Still further, the user can move both the overlying portion 20 and the blanket 11 to the respective open positions to expose the underlying and inner layer 30. In any selected open position, the overlying portion 20 and/or the blanket 11 exposes the inner layer 30 and/or the inner volume 104 for air circulation. Additionally, in any selected open position, the overlying portion 20 and/or the blanket 11 can be used as additional padding areas adjacent to the shell 12.

Figure 9:
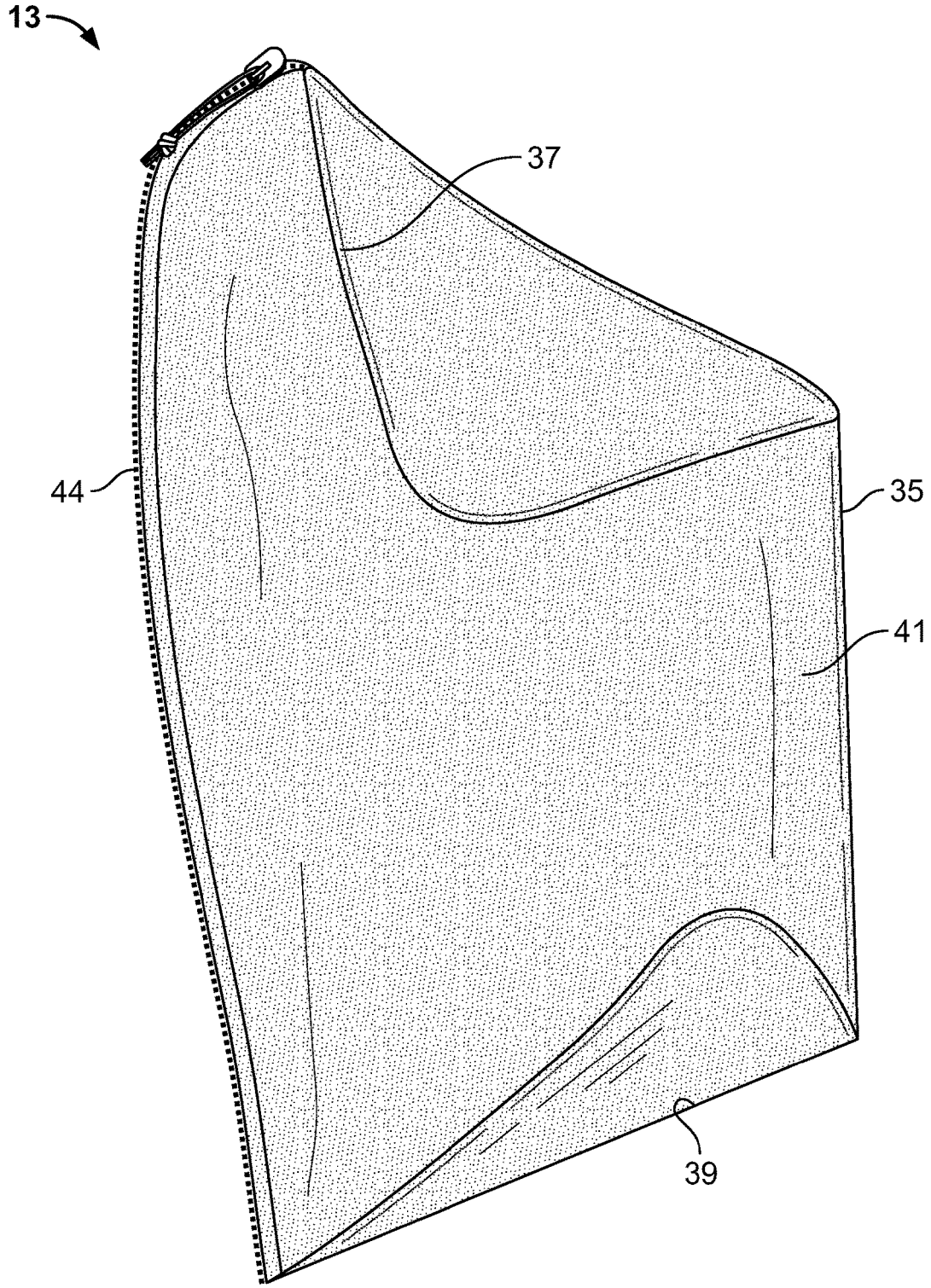
FIG. 9 is a partial view of another exemplary blanket which is removably coupled to the sleeping of FIG. 1 by a fastener.
Figure 10:
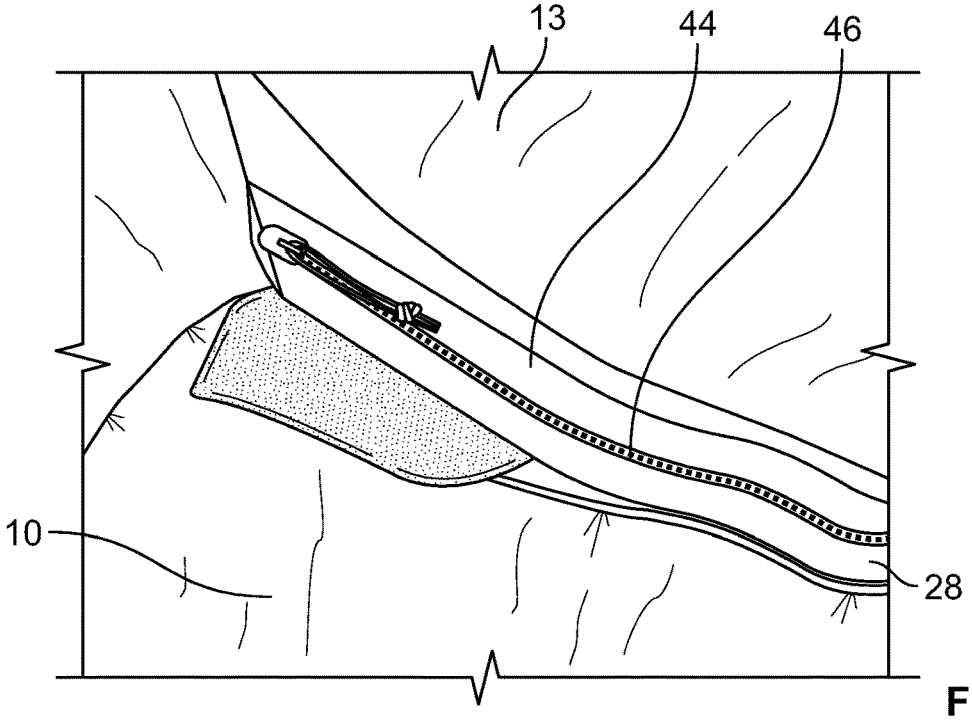
FIG. 10 is a partial view of an exemplary fastener removably coupling the blanket to the sleeping bag of FIG. 1.
Figure 11:
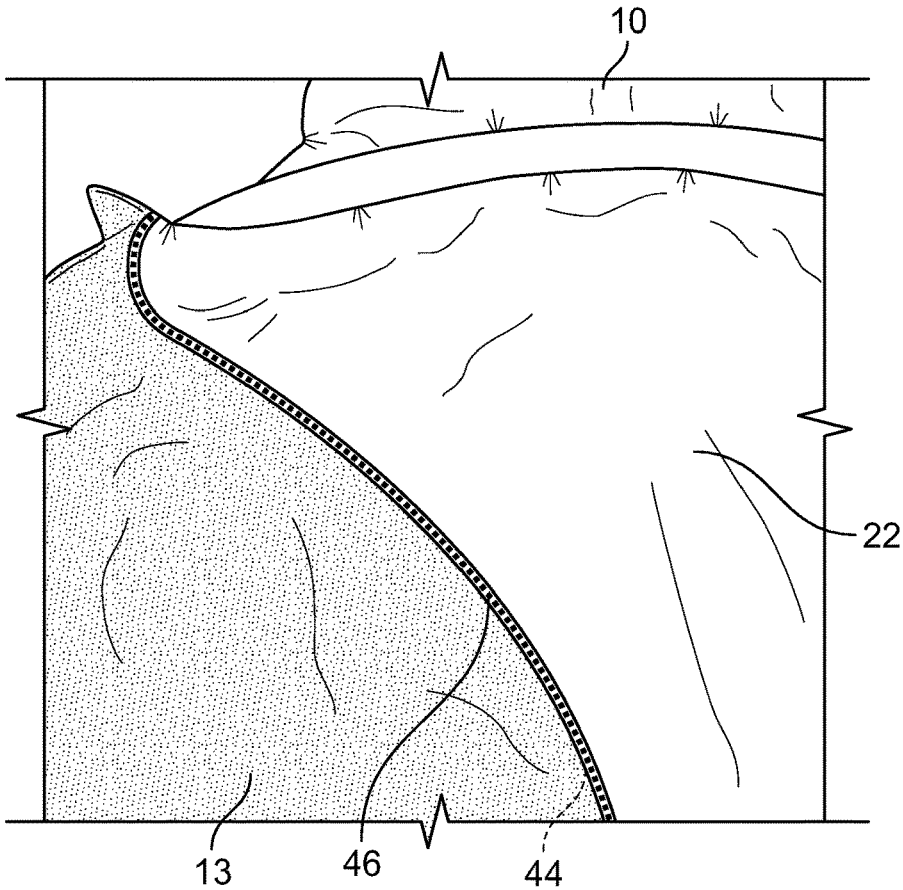
FIG. 11 is a partial view of an exemplary draft flap coupled to the blanket of the sleeping bag of FIG. 1.

FIG. 9 is a top plan and partial view of a removable blanket 13 coupled to the sleeping bag 10 (shown in FIG. 1) by a second fastener 44 such as, but not limited to, a second zipper. FIG. 10 is a partial view of the second zipper 44 removably coupling the blanket 13 to the sleeping bag 10 of FIG. 1. FIG. 11 is a partial view of the draft flap 46 coupled to the blanket 13 of FIG. 9. In the exemplary embodiment, the second zipper 44 is configured to removably couple the blanket 13 to the first side panel 28. Alternatively, the second zipper 44 can removably couple the blanket 13 to the second side panel 29. A portion of the transversely extending side edge 35 is removably coupled to the middle portion 16 and/or the inner layer 30 (shown in in FIGS. 3 and 4) by the second zipper 44. It is contemplated that the blanket 13 can be removably coupled to the shell 12 less the entire width and/or length of the shell 12. Moreover, the blanket 13 can be completely de-coupled or removed from the second zipper 44 and placed away from the shell 12 to provide a separate padding area for the user.

The second zipper 44 is configured to extend longitudinally along the middle portion 16 and parallel to the longitudinal center line CL. In an embodiment, the second zipper 44 can extend into the head portion 14. In another embodiment, the second zipper 44 stops short of the head portion 14, and particularly, before the arc of the first zipper 23 positioned in the head portion 14. In the embodiment where the second zipper 44 stops short of the head portion 14, the blanket 13 is configured to extend towards the hood 34 and will attach with a fastener (not shown) such as, for example only, a plastic snap for attaching to the interior of the sleeping bag 10. The second zipper 44 is configured to extend past the curved portion 38 of the first zipper 23, and extend at least partially into the foot portion 18. The second zipper 44 is configured to couple to the blanket 13 under the curved portion 38 and at least partially into the foot portion 18 to provide thermal comfort within the foot portion 18. Additionally, the blanket 13 is configured to extend beyond the ends of the second zipper 44 to facilitate preventing and/or eliminating cold spots near zipper ends while protecting the user from teeth of the second zipper 44. In an embodiment, the draft flap 46 is positioned between the underlying portion 22 and the second zipper 44. The draft flap 46 is configured to reduce and/or eliminate air flow from the exterior, across the second zipper 44, and into the inner volume 104. The draft flap 46 is configured to extend beyond ends of the second zipper 44 to facilitate reducing and/or eliminating cold spots near zipper ends while protecting the user from teeth of the second zipper 44.

Figure 12:
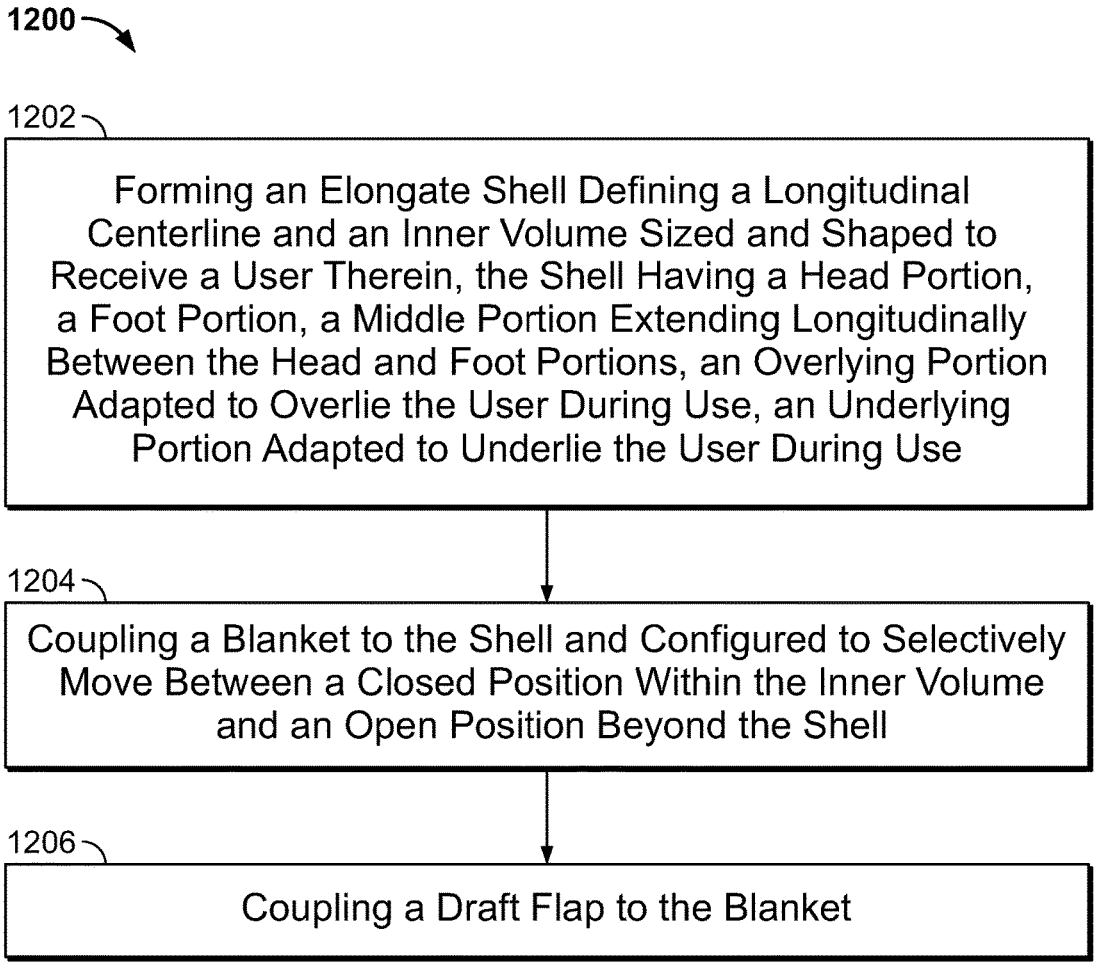
FIG. 12 is an exemplary flowchart illustrating manufacturing of the sleeping bag of FIG. 1.

FIG. 12 is a flowchart illustrating a method 1200 of manufacturing the sleeping bag 10. The method 1200 includes forming 1202 the elongate shell 12 defining the longitudinal centerline CL and an inner volume 104 sized and shaped to receive a user therein, the shell 12 having the head portion 14, the foot portion 18, and the middle portion 110 extending longitudinally between the head and foot portions 14, 18, wherein the overlying portion 20 is adapted to overlie the user during use, and wherein the underlying portion 22 is adapted to underlie the user during use. The method 1200 also includes coupling 1204 the blanket 11 to the shell 12 and configured to selectively move between the closed position 15 within the inner volume and the open position 17 beyond the shell 12. Moreover, in the exemplary method 1200, the draft flap 410 is coupled 1206 to the blanket 11. In an embodiment, the sleeping bag 10 is manufactured having the coded color schemes relating the varying thermal compositions of the blanket 11 and the shell 12.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

Exemplary embodiments of a sleeping bag are described herein. The methods and assemblies are not limited to the specific embodiments described herein, but rather, components of assemblies and/or steps of the methods may be utilized independently and separately from other components and/or steps described herein. For example, the methods may also be used in combination with other assemblies and methods, and are not limited to practice with only the assemblies and methods described herein. Rather, the exemplary embodiments may be implemented and utilized in connection with many other sleeping structures, blankets, and/or quilts.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using devices or assemblies or systems and performing any incorporated method. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sleeping bag comprising:

an elongate shell defining a longitudinal centerline and an inner volume sized and shaped to receive a user therein, the shell having a head portion, a foot portion, a middle portion extending longitudinally between the head and foot portions, an overlying portion adapted to overlie the user during use, and an underlying portion adapted to underlie the user during use, the overlying portion configured to selectively move between a closed overlying position in the inner volume and an open overlying position out of the inner volume; and a blanket coupled to the shell and configured to selectively move between a closed blanket position within the inner volume and an open blanket position beyond the shell, the blanket configured to move independent of the overlying portion during use when the overlying portion is in the closed overlying position.

2. The sleeping bag of claim 1, wherein the shell has a first composition, the overlying portion has a second composition, and the blanket has a third composition, and wherein the first composition, the second composition, and the third composition are different from each other.

3. The sleeping bag of claim 1, wherein the overlying portion is configured to selectively move between a closed overlying position within the inner volume and an open overlying position beyond the shell.

4. The sleeping bag of claim 3, wherein the blanket is positionable in the open blanket position when the overlying portion is positioned in the open overlying position.

5. The sleeping bag of claim 3, wherein the overlying portion is positionable in the open overlying position when the blanket is positioned in the closed blanket position.

6. The sleeping bag of claim 1, wherein the shell further comprises a head end panel, a foot end panel, a first side panel and a second side panel, the first side panel and the second side panel configured to extend longitudinally between the head end panel and the foot end panel.

7. The sleeping bag of claim 6, wherein the overlying portion and the blanket are each coupled to at least one of the first side panel and the second side panel.

8. The sleeping bag of claim 1, wherein the shell has a first color, the overlying portion has a second color, and the blanket has a third color, and wherein the first color, the second color, and the third color are different from each other.

9. The sleeping bag of claim 1, further comprising a first zipper coupled to the shell and comprising a straight portion positioned substantially parallel to the longitudinal centerline and a curved portion positioned substantially perpendicular to the longitudinal centerline.

10. The sleeping bag of claim 1, wherein the shell includes a shell width and the blanket includes a blanket width which is longer than the shell width.

11. The sleeping bag of claim 1, wherein, in the closed blanket position, the blanket is positioned between the overlying portion and the underlying portion.

12. The sleeping bag of claim 2, wherein the blanket is coupled to the second side panel.

13. A sleeping bag comprising:

an elongate shell defining an inner volume sized and shaped to receive a user therein, the shell having an overlying portion adapted to overlie the user during use, and an underlying portion adapted to underlie the user during use, the overlying portion configured to selectively move between a closed overlying position in the inner volume and an open overlying position out of the inner volume;

a blanket coupled to the shell and configured to selectively move between a closed blanket position within the inner volume and an open blanket position beyond the shell during use, the blanket configured to move independent of the overlying portion during use when the overlying portion is in the closed overlying position; and a draft flap coupled to the blanket.

14. The sleeping bag of claim 13, wherein the draft flap is positioned between the underlying portion and the blanket.

15. The sleeping bag of claim 13, further comprising a zipper coupled to the shell and to the blanket and wherein the draft flap is positioned between the underlying portion and the zipper.

16. The sleeping bag of claim 15, further comprising a zipper coupled to the shell and to the blanket and wherein the draft flap is configured to extend beyond the zipper.

17. The blanket of claim 13, wherein the blanket is removably coupled to the shell.

18. A method of manufacturing a blanket, the method comprising:

forming an elongate shell defining a longitudinal centerline and an inner volume sized and shaped to receive a user therein, the shell having a head portion, a foot portion, a middle portion extending longitudinally between the head and foot portions, an overlying portion adapted to overlie the user during use, an underlying portion adapted to underlie the user during use;

coupling a blanket to the shell and configured to selectively move between a closed position within the inner volume and an open position beyond the shell; and coupling a draft flap to the blanket.

19. The method of claim 18 further comprising forming the blanket having a width longer than a width of the shell.

20. The method of claim 18 further comprising forming the overlying portion having a composition, and forming the blanket having a composition that is different from the composition of the overlying portion.

* * * * *